US007321381B2

(12) United States Patent
Jang et al.

(10) Patent No.: US 7,321,381 B2
(45) Date of Patent: Jan. 22, 2008

(54) IMAGE FORMING APPARATUS AND CONTAMINATION PREVENTION MEMBER FOR USE THEREIN

(76) Inventors: Heung-kyu Jang, 101-1203 Samcheon-ri Gwonseon 2-cha Apt., Gwonseon-dong Gwonseon-gu, Suwon-si, Gyeonggi-do (KR); Se-hyun Lyu, 10-203 Samho Apt., Seocho 4-dong, Seocho-gu, Seoul (KR); Woo-chul Jung, 515-301 Samsung 5-cha Apt., Jinsan Maeul, 1168 Poongdeokcheon-ri, Suji-eup, Yongin-si, Gyeonggi-do (KR)

( * ) Notice: Subject to any disclaimer, the term of this patent is extended or adjusted under 35 U.S.C. 154(b) by 278 days.

(21) Appl. No.: 10/879,531

(22) Filed: Jun. 30, 2004

(65) Prior Publication Data

US 2005/0008390 A1 Jan. 13, 2005

(30) Foreign Application Priority Data

Jul. 1, 2003 (KR) ..... 10-2003-0044342

(51) Int. Cl.
*B41J 2/435* (2006.01)

(52) U.S. Cl. ..... 347/263

(58) Field of Classification Search ..... 347/263
See application file for complete search history.

(56) References Cited

U.S. PATENT DOCUMENTS 2,845,213 A * 7/1958 Tamarin ..... 206/264
4,970,552 A * 11/1990 Okamoto et al. ..... 399/98
6,029,028 A * 2/2000 Inoue ..... 399/92
6,339,491 B1 * 1/2002 Kondou et al. ..... 359/212
6,591,074 B1 * 7/2003 Michlin ..... 399/106

FOREIGN PATENT DOCUMENTS

| | | | |
|---|---|---|---|
| JP | 59-6261 | | 1/1984 |
| JP | 63-178260 | | 7/1988 |
| JP | 07-061468 | | 3/1995 |
| JP | 10-301050 | | 11/1998 |
| JP | 11-130146 | | 5/1999 |
| JP | 11-218983 | | 8/1999 |
| JP | 11218983 | A * | 8/1999 |
| JP | 2000039578 | A * | 2/2000 |
| JP | 2000-229459 | | 8/2000 |
| JP | 2001-117035 | | 4/2001 |

* cited by examiner

*Primary Examiner*—Hai Pham
*Assistant Examiner*—Kainoa Wright
(74) *Attorney, Agent, or Firm*—Roylance, Abrams, Berdo & Goodman, L.L.P.

(57) ABSTRACT

Provided is an image forming apparatus, which comprises a contamination prevention member that covers a top surface of a light window with one side exposed to an outside of a main body, which prevents a contamination material, such as dust, from getting onto the light window, and which a user can recognize and remove easily.

7 Claims, 4 Drawing Sheets

IMAGE FORMING APPARATUS AND CONTAMINATION PREVENTION MEMBER FOR USE THEREIN

PRIORITY

This application claims the benefit under 35 U.S.C. §119 (a) of Korean Patent Application No. 2003-44342, filed on Jul. 1, 2003, in the Korean Intellectual Property Office, the entire disclosure of which is incorporated herein by reference.

BACKGROUND OF THE INVENTION

1. Field of the Invention

The present invention relates to an electrophotographic image forming apparatus. More particularly, the present invention relates to an electrophotographic image forming apparatus having a contamination prevention member which prevents a laser scanning unit from becoming contaminated.

2. Description of the Related Art

Typically, an electrophotographic image forming apparatus, such as a laser beam printer, forms an image as a visible image on a sheet of paper in response to an image signal applied to the electrophotographic image forming apparatus.

The developing unit to which an image signal is applied, attaches toner to an electrostatic latent image formed on a photosensitive medium using a light scanning unit so that the visible image is formed. When the visible image is transferred and fused onto the sheet of paper, the image signal is formed onto the sheet of paper as a desired visible image.

The laser scanning unit forms an electrostatic latent image having a predetermined potential by radiating a laser beam on the surface of the photosensitive medium in response to the image signal. The laser scanning unit typically includes a plurality of optical systems such as a laser diode for generating a laser beam, a collimating lens, a polygon mirror and an f-θ lens.

The laser beam generated by the laser diode passes through the plurality of optical systems, and the electrostatic latent image is formed on the photosensitive medium. However, when the image forming apparatus is transferred to another place, dust, or in particular, toner powder, can contaminate the optical systems. Dust may enter the laser scanning unit during use, get onto portions of the embedded optical systems, and the laser beam irradiated from the laser diode can be disturbed by the dust, such that it does not pass through those portions of the optical systems and a desired electrostatic latent image is not formed on the photosensitive medium.

In order to solve this problem, according to Japanese Patent Publication No. 2001-117035, dust-tight glass is provided where the laser beam of the laser scanning unit is emitted so that dust, such as toner powder does not enter the laser scanning unit.

However, when dust gets onto the dust-tight glass, such as toner powder, the laser beam does not pass through that portion, and the desired electrostatic latent image may not be formed on the photosensitive medium.

In addition, a cleaning unit to which a brush is attached, is installed where the laser beam of the laser scanning unit is emitted so that when dust gets onto where the laser beam of the laser scanning unit is emitted, dust is removed by moving the cleaning unit.

In particular, due to vibration or shock occurring when the toner powder is mixed with toner or foreign substances during a test process and a product whose test is completed after manufacturing is delivered from a factory to a customer, the product may be shaken and toner powder may get onto where the laser beam of the laser scanning unit is emitted. If the customer uses the product in this state, the laser beam does not pass through the portions with the toner powder thereon, and the electrostatic latent image is not formed on the photosensitive medium. As such, image quality failures occur, and unnecessary repair services are required.

SUMMARY OF THE INVENTION

Embodiments of the present invention provide an image forming apparatus which prevents the contamination of a laser scanning unit occurring when a product is delivered to a customer, by attaching a contamination prevention member to the laser scanning unit.

According to an aspect of the present invention, there is provided an image forming apparatus comprising a laser scanning unit in which a light window through which a laser beam for forming an electrostatic latent image on a photosensitive medium in response to an image signal passes is placed, wherein the image forming apparatus includes a contamination prevention member, which covers a top surface of the light window with one side exposed to an outside of a main body, which prevents a contamination material, such as dust, from getting onto the light window, and which a user can recognize and remove easily.

BRIEF DESCRIPTION OF THE DRAWINGS

The above aspects and advantages of the present invention will become more apparent by describing in detail an exemplary embodiment thereof with reference to the attached drawings in which.

It should be understood that throughout the drawings, like reference numbers refer to like features and structures.

DETAILED DESCRIPTION OF THE INVENTION

Figure 1:
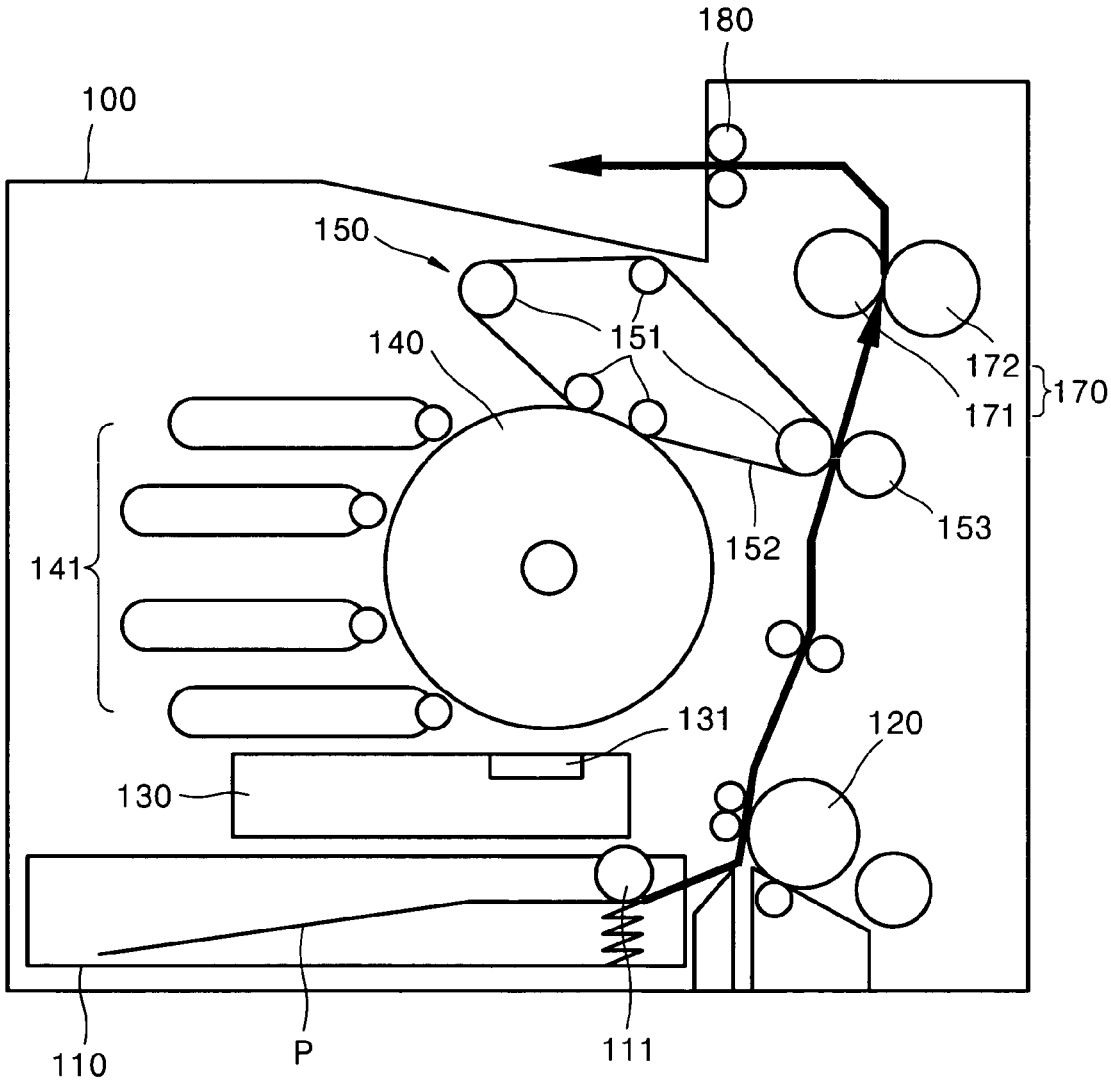
FIG. 1 illustrates a structure of an image forming apparatus using a contamination prevention member according to an embodiment of the present invention.
Figure 2:
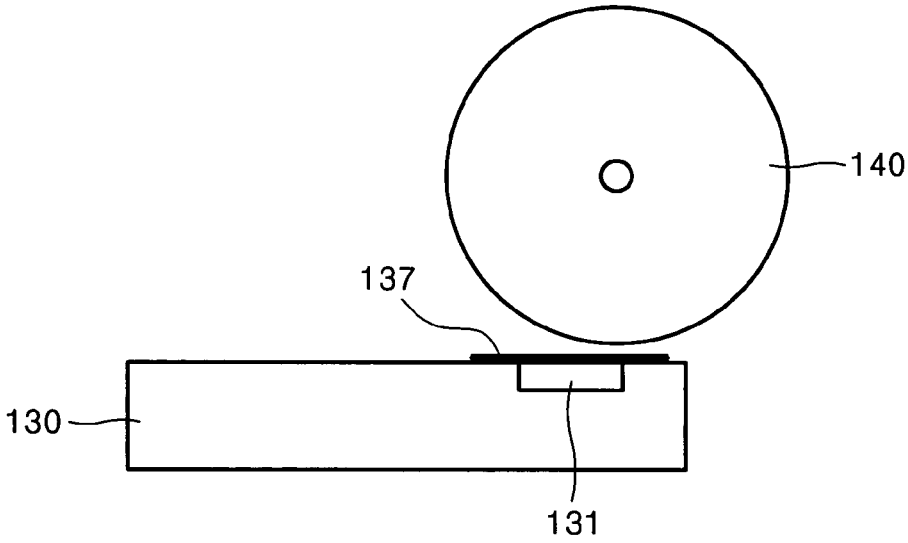
FIG. 2 is an extracted and enlarged view illustrating a positional relationship between a photosensitive medium of FIG. 1 and a laser scanning unit using the contamination prevention member.

Referring to FIGS. 1 and 2, an image forming apparatus includes a cassette 110, a laser scanning unit 130 using a contamination prevention member 137, a developing unit 141, a transfer unit 150, a fusing unit 170, and a paper exhaust unit 180.

The cassette 110 stacks a sheet of paper P on a lower portion of a main body 100 and is attached to and removed from the main body 100. The sheet of paper P is picked up by a pickup roller 111 which is rotatably installed in the main body 100 and is transferred into the main body 100.

The laser scanning unit 130 forms an electrostatic latent image on the surface of a photosensitive drum 140 in response to an image signal. A contamination prevention member 137, which prevents foreign substances from getting onto the light window 131 when the image forming apparatus is delivered from a factory to a user, is installed in the laser scanning unit 130.

The laser scanning unit 130 includes a plurality of optical systems, such as a laser diode for radiating a laser beam (not shown), a collimating lens, a polygon mirror, an f-θ lens, and a reflective mirror. The light window 131 through which the laser beam irradiated from the laser diode is emitted, faces the photosensitive drum 140. Accordingly, the laser beam irradiated from the laser diode is irradiated onto the surface of the photosensitive drum 140 through the light window 131 so that an electrostatic latent image is formed on the photosensitive drum 140.

Figure 3:
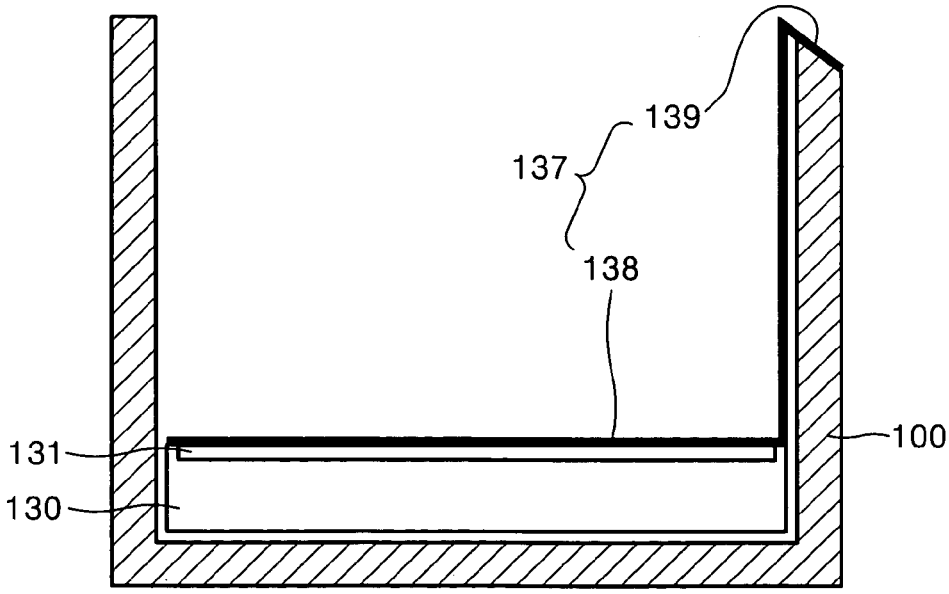
FIG. 3 is a front view illustrating a position in which the contamination prevention member of FIG. 1 is attached to a main body.

As shown in FIG. 3, the contamination prevention member 137 includes a cover portion 138 which covers the light window 131 and an instruction portion 139 which is exposed to an outside of the main body 100 and which is grasped by users easily.

Preferably, the cover portion 138 and the instruction portion 139 are connected to each other and are formed as a single body, and the instruction portion 139 has a width larger than the width of the cover portion 138 so that the user can easily grasp the instruction portion 139.

Preferably, an adhesive, by which the contamination prevention member 137 is easily attached to and removed from the light window 131, is attached to a rear side of the contamination prevention member 137. In this case, the contamination prevention member 137 is not permanently attached to the light window 131 so that the user can remove it from the light window 131 when the user uses the image forming apparatus. If an adhesive force is too strong, it is difficult to remove the contamination prevention member 137 from the light window 131, and even after removal, the adhesive may still be attached to the light window 131 and interfere with the laser passing through the light window 131.

Figure 4:
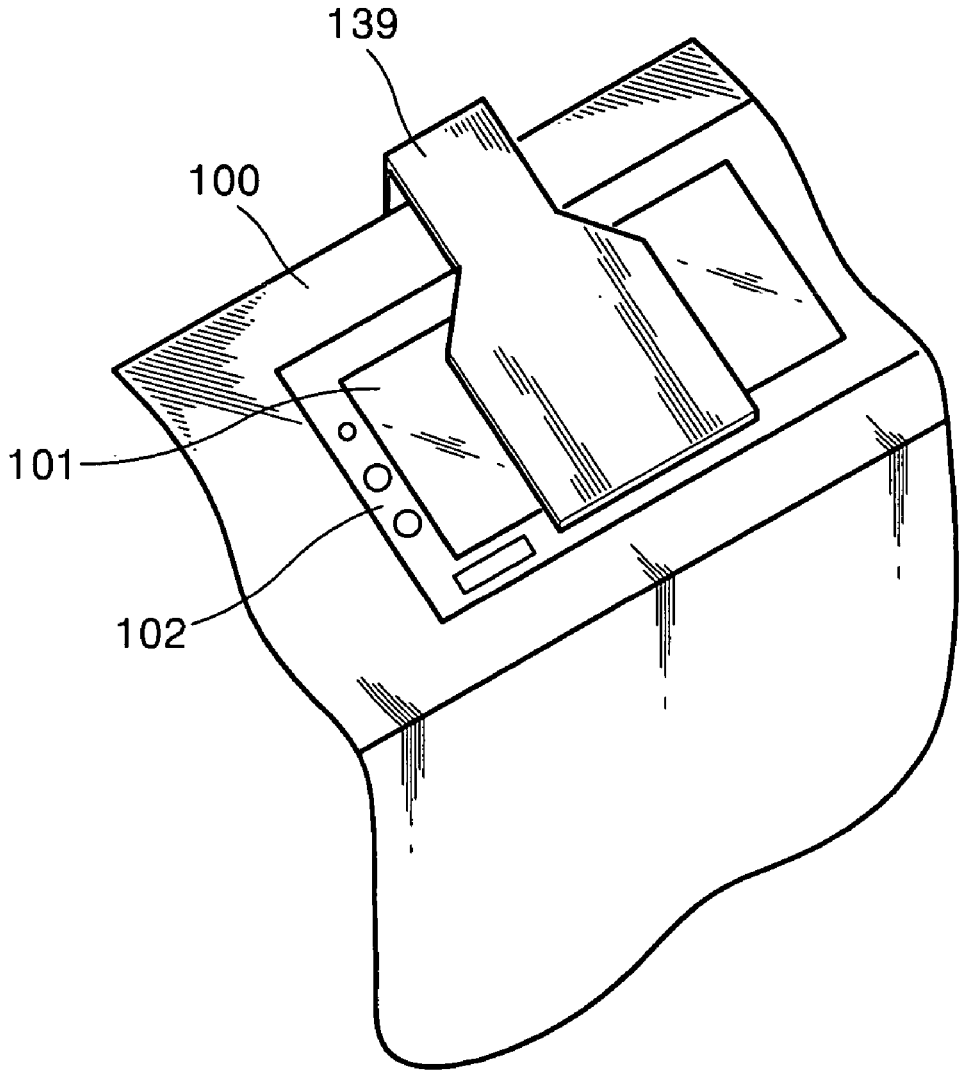
FIG. 4 is a partial enlarged perspective view illustrating the positioning of the instruction portion of FIG. 3.

As shown in FIG. 4, preferably, the instruction portion 139 is attached to a visible portion on a front surface of the image forming apparatus so that the user can recognize the instruction portion 139. In particular, preferably, the instruction portion 139 is attached to an operating portion 102, on which a display panel 101 is placed, so that the operating portion 102 can be operated by the user so as to operate the image forming apparatus and whether the operating portion 102 operates can be displayed on the display panel 101.

Figure 5:
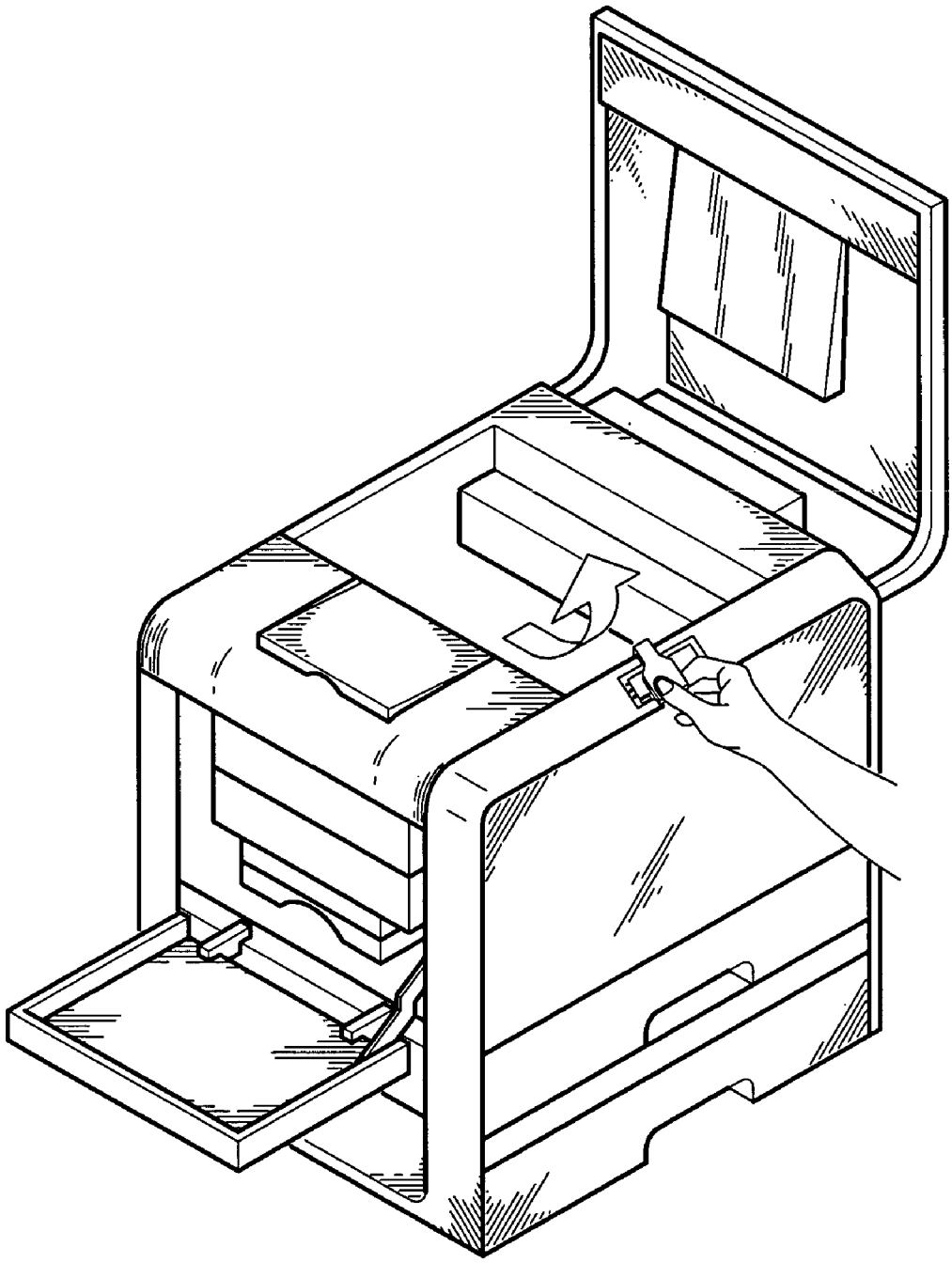
FIG. 5 is an enlarged view of the instruction portion as shown in FIG. 4.

As shown in FIG. 5, preferably, marks showing the user how to remove the contamination prevention member 137 are placed on the instruction portion 139 so that the user can easily remove the contamination prevention member 137.

Thus, after the image forming apparatus is manufactured and tested, but before the image forming apparatus is packaged and delivered to a user, the contamination prevention member 137 is attached to the light window 131. Thus, foreign substances are prevented from getting onto the light window 131 during delivery. Also, since the instruction portion 139 is exposed to an outside of the image forming apparatus, the user can remove the contamination prevention member 137 as indicated in the instruction portion 139, and then perform a printing operation.

The developing unit 141 comprises a plurality of ink cartridges, which contact the photosensitive drum 140 so as to develop an electrostatic latent image formed on the surface of the photosensitive drum 140 using the laser scanning unit 130 in response to the image signal, as a predetermined color image. Ink stored in the plurality of ink cartridges is superimposed and developed on the electrostatic latent image so that the predetermined color image is formed.

The transfer unit 150 preferably comprises a transfer belt 152 and a transfer backup roller 153. The transfer belt 152 is supported by a plurality of transfer belt backup rollers 151 and rotates on a closed curve, and the color image formed on the surface of the photosensitive drum 140 is transferred onto the transfer belt 152. The transfer backup roller 153 faces any one of the plurality of transfer belt backup rollers 151 such that the transfer belt 152 is placed between the transfer belt backup rollers 151 and the transfer backup roller 153, and presses the sheet of paper P toward the transfer belt 152 so that the color image transferred onto the transfer belt 152 is transferred onto the sheet of paper P.

The fusing unit 170 comprises a fusing roller 171 for generating heat and a pressing roller 172 which faces the fusing roller 171 such that the sheet of paper P is placed between the fusing roller 171 and the pressing roller 172 and presses the sheet of paper P toward the fusing roller 171. The fusing roller 171 applies heat to the sheet of paper P on which the predetermined color image is formed, and fuses the color image onto the sheet of paper P. The paper exhaust unit 180 exhausts the sheet of paper P on which the predetermined color image is formed from the apparatus.

As described above, in the image forming apparatus according to an embodiment of the present invention, a contamination prevention member is attached to the light window in order to prevent a light window of a laser scanning unit from being contaminated by foreign substances occurring during a product manufacturing process, or by vibration or shock occurring from an internal contamination source. The contamination prevention member is installed in the apparatus before the apparatus is transported to the user. The user can easily remove the contamination prevention member, thereby improving the reliability of the product.

While the present invention has been particularly shown and described with reference to exemplary embodiments thereof, it will be understood by those skilled in the art that various changes in form and details may be made therein without departing from the spirit and scope of the invention as defined by the following claims.

What is claimed is:

1. An image forming apparatus comprising:

a laser scanning unit having a dust-tight light window adapted to pass a laser beam for forming an electrostatic latent image on a photosensitive medium in response to an image signal, wherein the image forming apparatus includes a contamination prevention member, which is removably attached to and covers substantially the entire top surface of the light window with one side exposed to an outside of a main body, which prevents a contamination material from getting onto the light window, and which a user can recognize and remove easily, and which must be removed from the light window prior to a first use of the image forming apparatus by a user.

2. The image forming apparatus of claim 1, wherein the contamination prevention member includes a cover portion which covers a top surface of the light window, and an instruction portion which is exposed to an outside of the main body and which the user can grasp easily.

3. The image forming apparatus of claim 2, wherein the instruction portion has a width larger than the width of the cover portion, and comprises marks showing the user how to remove the contamination prevention member.

4. The image forming apparatus of claim 2, wherein the instruction portion is attached to a visible portion on a front surface of the main body.

5. The image forming apparatus of claim 4, wherein the instruction portion is attached to a display panel of an operating portion of the main body.

6. The image forming apparatus of claim 1, wherein said contamination prevention member comprises an adhesive by which the contamination prevention member is easily attached to and removed from the light window attached to a rear side of the contamination prevention member.

7. The image forming apparatus of claim 1, wherein the contamination prevention member is attached to an covers a top surface of the light window during manufacturing of the image forming apparatus.

* * * * *